US005887900A

United States Patent [19]

Raymond

[11] Patent Number: 5,887,900

[45] Date of Patent: Mar. 30, 1999

[54] SCRAPBOOK RETAINER SYSTEM

[76] Inventor: Rosie L. Raymond, 7241 Restgate Rd., New Orleans, La. 70127

[21] Appl. No.: 864,008

[22] Filed: May 27, 1997

Related U.S. Application Data

[60] Provisional application No. 60/018,876, Jun. 4, 1996.

[51] Int. Cl. [6] ..... B42D 1/08; B42F 5/00; A44B 1/08

[52] U.S. Cl. ..... 281/22; 281/45; 281/46; 281/28; 402/79; 402/80 R; 24/67.9; 24/DIG. 10; D19/75; D19/86; 283/67

[58] Field of Search ..... 281/22, 28, 38, 281/45, 46; 402/79, 80 R, 73, 26; D19/86, 65, 75; 24/67.9, 547, 546, DIG. 10; 283/67

[56] References Cited

U.S. PATENT DOCUMENTS

| | | | |
|---|---|---|---|
| D. 372,937 | 8/1996 | Anders | D19/65 |
| D. 383,785 | 9/1997 | Shyu | D19/65 |
| D. 383,786 | 9/1997 | Shyu | D19/65 |
| D. 385,303 | 10/1997 | Anders | D19/65 |
| D. 388,827 | 1/1998 | Shyu | D19/65 |
| D. 396,885 | 8/1998 | Shyu | D19/65 |
| 505,407 | 9/1893 | Merrill . | |
| 793,826 | 7/1905 | Damico . | |
| 806,861 | 12/1905 | Wolf | 281/46 |
| 866,141 | 9/1907 | Kay, Jr. . | |
| 988,686 | 4/1911 | Baldwin | 281/46 |
| 1,247,087 | 11/1917 | Noyer . | |
| 1,327,992 | 1/1920 | Fritzsche | 281/46 |
| 1,454,182 | 5/1923 | Myer | 281/46 |
| 1,551,467 | 8/1925 | Carousso . | |
| 1,600,748 | 9/1926 | Bader . | |
| 1,734,658 | 11/1929 | Veil . | |
| 1,805,833 | 5/1931 | McLeod, Jr. . | |
| 1,989,953 | 2/1935 | Tibbals . | |
| 2,262,598 | 11/1941 | Wilson . | |
| 2,452,514 | 10/1948 | Zychlinski . | |
| 2,455,399 | 12/1948 | Botts . | |
| 2,502,289 | 3/1950 | Szent-Gyorgyi . | |
| 2,938,252 | 5/1960 | Scheemaeker . | |
| 2,947,047 | 8/1960 | Guzell . | |
| 3,095,624 | 7/1963 | Croisant . | |
| 3,123,924 | 3/1964 | Roberts . | |
| 3,308,784 | 3/1967 | Miller . | |
| 3,348,271 | 10/1967 | Miller . | |
| 3,596,928 | 8/1971 | Edmonds | 281/46 |
| 4,589,682 | 5/1986 | Ballard | 281/46 |
| 4,645,237 | 2/1987 | Squire | 281/46 |
| 4,681,232 | 7/1987 | Du Corday | 281/46 |
| 5,186,496 | 2/1993 | Seki | 281/46 |
| 5,248,165 | 9/1993 | Lanzarin | 281/46 |
| 5,544,920 | 8/1996 | Lanzarin | 281/46 |
| 5,729,870 | 3/1998 | Sharp | 24/67.9 X |

*Primary Examiner*—Frances Han
*Attorney, Agent, or Firm*—C. Emmett Pugh; Pugh/Associates

[57] ABSTRACT

A retainer clip (1) for holding mementos and keep-sakes, such as greeting cards (7), invitations, ticket stubs, and the like, particularly multi-page ones, within a multi-ringed binder scrapbook (11) so as to typically not damage the memento in any way, while allowing the complete viewing of the memento, including the front and back pages of a multi-page item. The clip has an item clip retainer portion (3), which can be substantially similar to a conventional paper clip, with a binder ring retainer portion (5) attached to the item clip retainer portion, which binder retainer portion secures the clip to at least two of the rings (9) of the multi-ring binder scrapbook. The clip preferably has two, parallel, extended, oval-shaped portions, one longer than the other, with the shorter, ring attachment portion being shorter but having a length to extend across at least two, spaced rings of a multi-ring binder.

20 Claims, 1 Drawing Sheet

SCRAPBOOK RETAINER SYSTEM

REFERENCE TO RELATED APPLICATION

This application is related to Provisional patent application Ser. No. 60/018,876, filed Jun. 4, 1996, entitled "Scrapbook Retainer Clip System", the disclosure of which is incorporated herein by reference.

TECHNICAL FIELD

The present invention relates to a scrapbook and retainer clip used therewith, id and more particularly to a multi-ring binder scrapbook capable of holding, for example, a number of substantially flat items, for example, greeting cards and other mementos, of which at least some have a number of connected pages or folds, and more particularly to a scrapbook system in which the items are held in the binder via special, unique retainer clips so that the each of the items may be separately reopened and re-read or otherwise viewed, including both the front and back of each page of each item, typically without damage to the stored item or removal from the scrapbook.

BACKGROUND ART

Various attempts have been made over the last many years at providing an organized means for arranging keepsakes and mementos, such as, for example, greeting cards, pictures, invitations, etc., but all have been unsatisfactory.

Some of these methods include providing a bound volume with blank pages upon which the user attaches the keepsakes with whatever means are available. This results in the keepsakes being taped, glued, or stapled to the pages which inhibit their further viewing, particularly in the case of greeting cards which need to be opened or turned over to be fully enjoyed or reviewed in their entirety, including the front and back pages of each item, including multiple-page items.

Another method includes providing adhesive corners which are glued to a blank page and hold the memento in place at its corners. Or the memento can simply be taped or glued to a blank page. Both of these methods are fairly invasive to the memento, and they do not last since the adhesives tend to dry out after several years and no longer stick to the page or memento. This is unsatisfactory since scrapbooks are typically meant to be kept a lifetime and even passed down through future generations.

A further known method of compiling scrapbooks is to utilize pages with clear plastic sheeting. The plastic sheeting may act either as an adhesive in combination with the page holding the memento in place or may form a pocket into which the memento may be inserted. The first of these methods is unsatisfactory for the same reasons that the above mentioned adhesive methods were unsatisfactory. Further, both methods require removal or dissembling of the scrapbook in order to fully view a multiple-page memento such as a greeting card. Still further, with respect to the plastic pocket method, the pockets are generally of a small uniform size which accordingly do not allow for the variety of sizes and shapes likely to occur amongst most collections of keepsakes.

The present invention satisfies this long-standing need without any of these problems of the prior art and does so in a cost effective, reliable manner, making a significant contribution to the useful arts.

GENERAL SUMMARY DISCUSSION OF INVENTION

The present invention thus provides an organized means for arranging keepsakes and mementos, such as, for example, greeting cards, pictures, invitations, etc., particularly those having multiple pages, by preferably utilizing a multi-ring binder scrapbook capable of holding, for example, such greeting cards and other mementos using special retainer clips so that all of the pages of the multiple page memento may be reopened and re-read or otherwise viewed, including both the front side, as well as the back-side of each page, including the bottom-most page, typically without damage or removal from the scrapbook.

In the preferred embodiment, the invention provides a scrapbook ring binder system for storing at least one, substantially flat, multiple page, memento item, each page of the memento item having a front side and a back-side, with the system further comprising:

a scrapbook ring binder having a front cover side and a back cover side, attached to one another at a spine, and at least two, spaced rings attached to the spine, each of the rings having a shank with an extended length, an upper ring and a lower ring spaced from the upper ring;

a retainer clip associated with said binder but being separable from aid binder, said retainer clip having two portions, a ring attachment portion and an affixed, extended, clip portion, with the ring attachment portion having an interior opening through it of a size allowing it to be placed over and move along the shank of at least one of the rings and thereby become temporarily attached to one of the ring, while also allowing it to be moved along the extended length of the shank of the ring, with the ring attachment portion being longitudinally extended, being longer than it is wide, and having an open interior of a length greater than the spacing distance between the two rings, allowing it to be placed over and ride along both rings at the same time, and with the clip portion being clipable over and thereby attachable to the bottom-most page of the item, either at its top or bottom, allowing the other pages of the item to be folded open when so clipped and attached, allowing for the viewing of all pages of the item, including the front and back-side of each page, while the ring attachment portion allows the clipped item to be moved from one side of the binder to the other along the extended length of the shank of the ring, both the ring attachment portion and the clip portion each preferably having separate, longitudinally extended oval shapes, disposed along side of one another in a parallel array, and preferably are attached to one another along a common side edge, with the ring attachment portion and the clip portion being flat with both lying in the same geometric plane, with the clip portion preferably being substantially longer than the ring attachment portion, extending past at least one end of the ring attachment portion, but preferably sharing the same terminus ends at one end of the ring attachment portion.

In the preferred system, there preferably are a multitude of substantially flat, multiple page items, each page of each item having a front side and a back side, and wherein the preferred scrapbook system further includes:

a multitude of the retainer clips associated with the binder but with each being separable from the binder, with each of the retainer clips, as noted above, having two portions, a ring attachment portion and an affixed, extended, clip portion, with most, if not all, of the retainer clips being identical except where they are located with respect to the rings of said scrapbook binder and with respect to the memento item being retained, although various size or lengths of the retainer clips could also be provided, if so desired, for, for example, accommodating different size mementos.

In the most preferred embodiment, in the scrapbook ring binder system of the invention, the ring binder has at least three and preferably four (or more), spaced rings, and at least some of the memento items being retained have a height spanning at least three (or more) of the spaced rings, and there are at least two of the retainer clips for the item, one located at the top of the item and one located at the bottom of the item, with the ring attachment portion of each of the retainer clips spanning at least two of the exemplary four rings, with there being at least one different ring in each one of the ring attachment portions of the retainer clips, all as can be seen and understood from the embodiment(s) described below.

The invention also provides a preferred scrapbook storage method, including preferably a multi-ring, scrapbook binder, for storing at least one (and typically many more), substantially flat, multiple page, memento item, with each page of the item having a front side and a back side, with the preferred method comprising the following steps:

a. using the scrapbook multi-ring binder and at least one retainer clip (and typically many more clips) with, as noted above, each clip being separable from the binder and with each retainer clip having two portions, a ring attachment portion and an affixed, extended, clip portion, with the ring attachment portion having an interior opening through it of a size allowing it to be placed over and move along the shank of at least two of the spaced rings and thereby become temporarily attached to the selected ones of the rings, while also allowing it to be moved along the extended lengths of the shanks of the rings, with said clip portion being clipable over and thereby attachable to the bottom-most page of the item, allowing the other pages of the item to be folded open when so clipped and attached, allowing for the viewing of all pages of the item, including the front and back-side of each page, while the ring attachment portion allows the clipped item to be moved from one side of the binder to the other along the extended length of the shanks of the selected rings; and b. clipping the clip portion to the bottom-most page of the multi-page memento and, after opening the rings in a manner well known in the art of ring binders, slipping the ring retainer portion over at least two rings and then closing the rings, attaching the memento to the rings of the scrapbook binder, while allowing the pages of the bottom-most page to be freely folded open, fully exposing both the front and back page portion of each such page, with the movement of the ring attachment portion over the extended length of the shanks of the rings allowing the clipped memento to be moved from one side of the binder to the other side, exposing the back side of the bottom-most side of the back page of the memento to be viewed, thereby allowing all page of the multi-page item to be viewed without removing the retainer clip from the memento or removing the retainer clip from the rings of the scrapbook binder.

Additionally, when there are at least three, and preferably four, rings in the scrapbook binder, the preferred method includes the steps of clipping at least two of the retainer clips onto the item, one located at the top of the item and one located at the bottom of the item, with the ring attachment portion being placed on selected rings with at least one different ring being located in each one of the ring attachment portions of the retainer clips, all as can be seen and understood from the embodiment(s) described below.

It is thus a particular object of the present invention to provide a system of attaching mementos to a multi-ring binder scrapbook that is non-invasive to the memento, that allows for the full viewing and enjoyment of multi-page mementos without removal, and that will last for a significantly long time, if not indefinitely.

Other advantages, achievements, and objects of the present invention will become apparent in considering the preferred, exemplary embodiment(s) described below.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
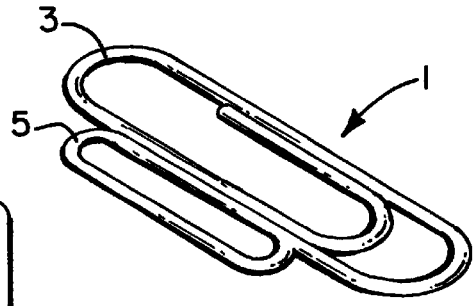
FIG. 1 is a perspective view of the currently preferred, exemplary embodiment of the flat retainer clip used in the exemplary, preferred embodiment of the present invention.
Figure 4:
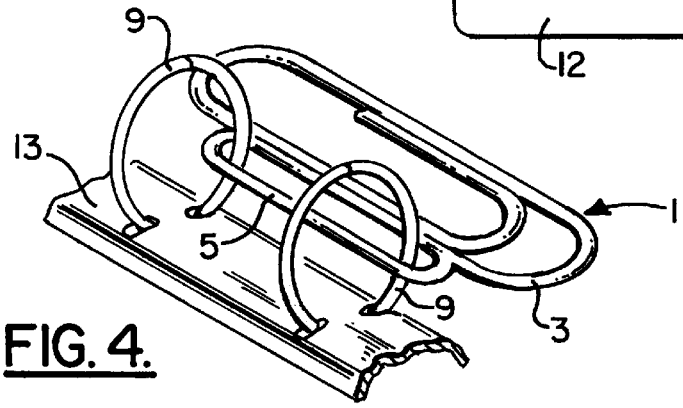
FIG. 4 is a close-up view of the retainer clip of FIG. 1 showing its inter-selected connection to an exemplary two of the rings of an exemplary multi-ring binder, such as the scrapbook binder illustrated in FIGS. 2 & 3.

As shown in FIGS. 1 and 4, the currently preferred, exemplary embodiment of the binder retainer clip 1 of the present invention is comprised of two portions, an item or memento retainer or clip portion 3 and an adjacent, affixed binder ring retainer or attachment portion 5. The item retainer or clip portion 3 is substantially shaped in similar fashion to that of a conventional paper clip, while the binder retainer or ring attachment portion 5 is comprised of an elongated loop, having an extended oval shape, attached lengthwise along the length of a common side edge of the item retainer or clip portion 3.

The item retainer clip portion 3 functions to clip onto and hold a selected portion of a memento 7 in the same manner as a conventional paper clip, while the binder retainer clip or ring attachment portion 5 is slippable over at least one and preferably at least two or more open binder rings 9.

The scrapbook retainer clip 1 may be made, for example, of appropriately bent wire, or molded plastic, or plastic coated wire, etc., and may be of a variety of colors and shapes. The sizes of the scrapbook retainer clip may vary to the same extent as do, for example, conventional paper clips. As one of ordinary skill would understand, in such designs or manufacturing approaches, both the ring attachment portion 5 and the clip portion 3 would then consist of a series of connected members of the same, relatively small thickness in comparison to the over-all size of said retainer clip 1, with an interconnected, permanently affixed wall between them, forming a relatively rigid, interconnected affixment between them.

Figure 3:
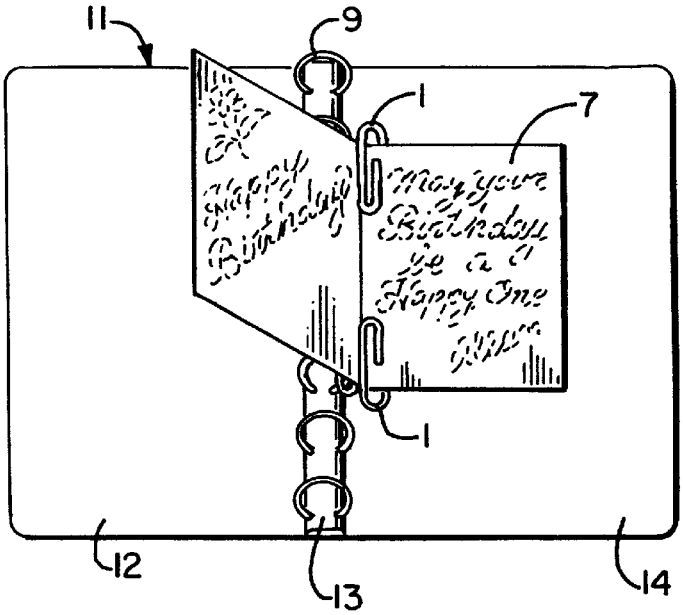
FIG. 3 is a perspective view similar to FIG. 2 but showing the front page of the exemplary greeting card memento opened up to the inside panels of the card, with the retainer clip's clipping attachment to the bottom-most page of the card then being better seen.

The item retainer or clip portion 3 clips onto the inside of a greeting card 7, i.e., over its bottom-most page, as shown in FIG. 3, so that the card may be opened and re-read or otherwise viewed while remaining in the scrapbook and without un-securing the clip(s) 1 from the multi-page memento. Preferably two binder retainer clips 1 are used per item, one at each end, for example, its top and bottom ends, unless the item is fairly small, in which case a single clip 1 may do. If the items are substantially larger, more than two clips 1 can be used to secure the large memento into the ringed, scrapbook binder 11.

Having viewed a particular item in the scrapbook 11, the viewer simply turns the item over and around the binder rings 9, as in turning a page, to view the next item or to view the back-side panel, or page of the memento 7. The scrapbook binder 11 may additionally have plastic or paper sheets also attached to the binder rings for separating one memento item from an adjacent one in the scrapbook into page-type sections.

Figure 2:
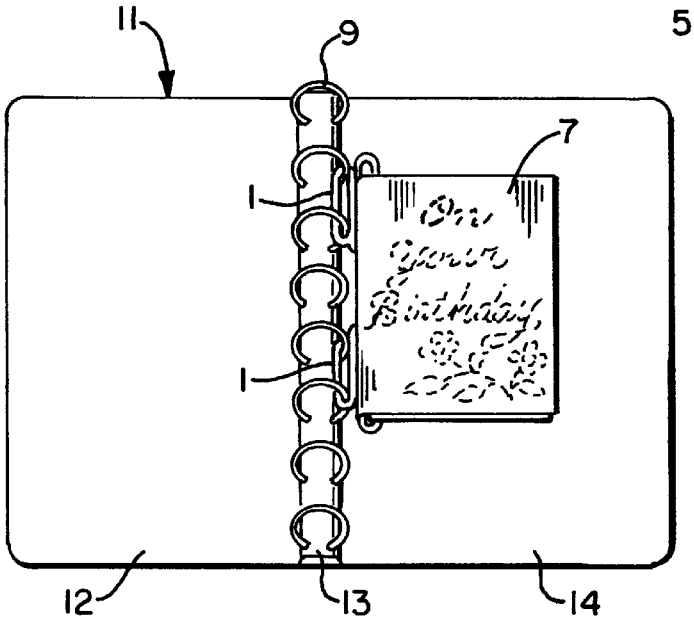
FIG. 2 is a is a perspective view showing the retainer clip (the clip portion of which is substantially unseen) of FIG. 1 being used to hold an exemplary, multi-page memento, namely a greeting card, in a multi-ring binder having an exemplary eight rings.

The scrapbook binder itself preferably has multiple rings, for example, and exemplary eight rings, as shown in FIGS. 2 & 3, so as to permit two rings to engage each binder retainer or attachment portion 5 of the clip 1, as shown in FIG. 4. The distance between each binder ring can be, for example, one to two (1"–2") inches, with the clips 1, particularly the ring attachment portion 5 thereof, accordingly dimensioned.

As is well known to those of ordinary skill in the art of ring binders, the exemplary scrapbook storage binder 11 typically includes a front cover 12 and a back cover 14 attached together by a spine 13, upon which the rings 9 are mounted to be opened and closed, whenever desired to, for example, attach or removed items, such as, for example, the clipped mementos 1/7 of the invention.

Exemplary dimensions for an exemplary retainer clip 1, which exemplary particulars are subject to great variation, are:

length of clip portion 3 one and a half inches (1.5")

width of clip portion 3 half an inch (0.5")

length of ring attachment portion 5 half an inch (0.5")

width of ring attachment portion 5 quarter inch (0.25")

Thus, it should be understood from the foregoing that, through the scrapbook storage system, including the exemplary scrapbook storage binder 11 and the exemplary retainer clips 1, described above, the invention inter alia:

provides a means of storing mementos for easy perusal typically without damage from handling or glue;

eliminates the clutter of numerous boxes of cards, letters and certificates that occupy valuable space in closets, chests, etc.;

is ideal for greeting cards, photos or trading cards too special to store in a box or drawer; and provides a novel gift for collectors or sentimentalists.

It is noted that the terms "multi-page" or "multiple pages" as used herein, do not necessarily refer to pages of paper or heavier stock material, although that is a particularly preferred embodiment or application, but also refer to anything that can be folded into a number of folds producing at least two "pages", and still be reasonably stored in a ringed binder, including, for example, cloth material, etc.

Additionally, although at least two rings or more is more preferred, the invention could also be applied to a single ring binder, in which case the ring attachment need not be extended and indeed could be, for example, merely circular ring having a diameter greater than the diameter of the ring body member. Additionally, although using the retainer clips hereof in connection with a multiple ring scrapbook or other binder is particularly efficacious and preferred, the retainer clips could be used with other types of storage systems as well.

It is further noted that the embodiment(s) described herein in detail for exemplary purposes is/are subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A ring binder system for storing at least one, substantially flat, multiple page item, each page of the item having a front side and a back side, said system further comprising:

a ring binder having a front cover side and a back cover side, attached to one another at a spine, and at least one ring attached to said spine, said ring having a shank with an extended length;

a retainer clip associated with said binder but being separable from said binder, said retainer clip having two portions, a ring attachment portion and an affixed, extended, clip portion, said ring attachment portion having an interior opening through it of a size allowing it to be placed over and move along the shank of said ring and thereby become temporarily attached to said ring, while also allowing it to be moved along the extended length of said shank of said ring, said clip portion being clipable over and thereby attachable to the bottom-most page of the item, allowing the other pages of the item to be folded open when so clipped and attached, allowing for the viewing of all pages of the item, including the front and back-side of each page, while said ring attachment portion allowing the clipped item to be moved from one side of the binder to the other along the extended length of said shank of said ring.

2. The ring binder system of claim 1, wherein:

said ring attachment portion and said affixed, extended, clip portion are flat, with both lying in the same geometric plane.

3. The ring binder system of claim 1, wherein:

said affixed, extended, clip portion has an extended oval shape.

4. The ring binder system of claim 1, wherein said binder has at least two, spaced rings, an upper ring and a lower ring spaced from said upper ring, and wherein:

said ring attachment portion is longitudinally extended, being longer than it is wide, and has an open interior of a length greater than the spacing distance between said two rings, allowing it to be placed over and ride along both rings at the same time.

5. The ring binder system of claim 4, wherein:

both said ring attachment portion and said clip portion each have separate, longitudinally extended oval shapes, disposed along side of one another in parallel array, and are attached to one another along a common side edge, said ring attachment portion and said clip portion being flat, with both lying in the same geometric plane.

6. The ring binder system of claim 5, wherein:

both said ring attachment portion and said clip portion consist of a series of connected members of the same, relatively small thickness in comparison to the over-all size of said retainer clip, with an interconnected, permanently affixed wall between them, forming a relatively rigid, interconnected affixment between them.

7. The ring binder system of claim 5, wherein:

said clip portion is substantially longer than said ring attachment portion, extending past at least one end of said ring attachment portion.

8. The ring binder system of claim 7, wherein:

said clip portion and said ring attachment portion share a common terminus end, with said clip portion extending substantially past the opposite terminus end of said ring attachment portion.

9. The ring binder system of claim 1, wherein there are a multitude of substantially flat, multiple page items, each page of each item having a front side and a back side, and wherein said system further includes:

a multitude of said retainer clips associated with said binder but each being separable from said binder, each of said retainer clips having two portions, a ring attachment portion and an affixed, extended, clip portion, most, if not all, of said retainer clips being identical except where they are located with respect to the rings of said scrapbook binder and with respect to the memento item being retained.

10. The ring binder system of claim 1, wherein said ring binder has at least four, spaced rings and the item being retained has a height spanning at least three of said spaced rings, and wherein there is included:

at least two of said retainer clips for the item, one located at the top of the item and one located at the bottom of the item, the ring attachment portion of each said retainer clips spanning at least two of said four rings, with there being at least one different ring in each one of the ring attachment portions of said retainer clips.

11. The ring binder system of claim 1, wherein said ring binder is a scrapbook and the item being retained is a memento.

12. A scrapbook ring binder system for storing at least one, substantially flat, multiple page, memento item, each page of the item having a front side and a back side, said system further comprising:

a scrapbook ring binder having a front cover side and a back cover side, attached to one another at a spine, and at least two, spaced rings attached to said spine, each of said rings having a shank with an extended length, an upper ring and a lower ring spaced from said upper ring;

a retainer clip associated with said binder but being separable from said binder, said retainer clip having two portions, a ring attachment portion and an affixed, extended, clip portion, said ring attachment portion having an interior opening through it of a size allowing it to be placed over and move along the shank of at least one of said rings and thereby become temporarily attached to said one of said ring, while also allowing it to be moved along the extended length of said shank of said ring, said ring attachment portion being longitudinally extended, being longer than it is wide, and having an open interior of a length greater than the spacing distance between said two rings, allowing it to be placed over and ride along both rings at the same time, said clip portion being clipable over and thereby attachable to the bottom-most page of the item, allowing the other pages of the item to be folded open when so clipped and attached, allowing for the viewing of all pages of the item, including the front and backside of each page, while said ring attachment portion allowing the clipped item to be moved from one side of the binder to the other along the extended length of said shank of said ring, both said ring attachment portion and said clip portion each having separate, longitudinally extended oval shapes, disposed along side of one another in parallel array, and are attached to one another along a common side edge, said ring attachment portion and said clip portion being flat with both lying in the same geometric plane, said clip portion being substantially longer than said ring attachment portion, extending past at least one end of said ring attachment portion.

13. The scrapbook ring binder system of claim 12, wherein there are a multitude of substantially flat, multiple page items, each page of each item having a front side and a back side, and wherein said system further includes:

a multitude of said retainer clips associated with said binder but each being separable from said binder, each of said retainer clips having two portions, a ring attachment portion and an affixed, extended, clip portion, most, if not all, of said retainer clips being identical except where they are located with respect to the rings of said scrapbook binder and with respect to the memento item being retained.

14. The scrapbook ring binder system of claim 12, wherein said ring binder has at least four, spaced rings and the item being retained has a height spanning at least three of said spaced rings, and wherein there is included:

at least two of said retainer clips for the item, one located at the top of the item and one located at the bottom of the item, the ring attachment portion of each said retainer clips spanning at least two of said four rings, with there being at least one different ring in each one of the ring attachment portions of said retainer clips.

15. A retainer clip for clipping a multi-page item to at least two, spaced rings of a multi-ring, storage device, each ring having an extended shank, comprising:

a ring attachment portion and an affixed, extended, clip portion, said ring attachment portion having an interior opening through it of a size allowing it to be placed over and move along the shank of at least two of said rings and thereby become temporarily attached to said two rings, while also allowing it to be moved along the extended length of the shank of the ring, said ring attachment portion being longitudinally extended, being longer than it is wide, and having an open interior of a length greater than the spacing distance between the two rings, allowing it to be placed over and ride along both rings at the same time, said clip portion being clipable over and thereby attachable to the bottom-most page of the item, allowing the other pages of the item to be folded open when so clipped and attached, allowing for the viewing of all pages of the item, including the front and backside of each page, while said ring attachment portion allowing the clipped item to be moved from one side of the rings to the other along the extended lengths of the shank of the rings, both said ring attachment portion and said clip portion each having separate, longitudinally extended oval shapes, disposed along side of one another in parallel array, and are attached to one another along a common side edge, said ring attachment portion and said clip portion being flat with both lying in the same geometric plane, said clip portion being substantially longer than said ring attachment portion, extending past at least one end of said ring attachment portion.

16. The retainer clip of claim 15, wherein:

both said ring attachment portion and said clip portion consist of a series of connected members of the same, relatively small thickness in comparison to the over-all size of said retainer clip, with an interconnected, permanently affixed wall between them, forming a relatively rigid, interconnected affixment between them.

17. The retainer clip of claim 16, wherein:

said clip portion and said ring attachment portion share a common terminus end, with said clip portion extending substantially past the opposite terminus end of said ring attachment portion.

18. The retainer clip of claim 15, wherein said rings are part of a scrapbook, multi-ring binder, and the item being clipped is a multi-page memento to be retained in the scrapbook binder.

19. A scrapbook method, including a multi-ring, scrapbook binder, for storing at least one, substantially flat, multiple page, memento item, each page of the item having a front side and a back side, said method comprising the following steps:

a. using a scrapbook ring binder having a front cover side and a back cover side, attached to one another at a spine, and at least two, spaced rings attached to said spine, each of said rings having a shank with an extended length, an upper ring and a lower ring spaced from said upper ring; and at least one retainer clip associated with said binder but being separable from said binder, said retainer clip having two portions, a ring attachment portion and an affixed, extended, clip portion, with said ring attachment portion having an interior opening through it of a size allowing it to be placed over and move along the shank of at least one of said rings and thereby become temporarily attached to said one of said ring, while also allowing it to be moved along the extended length of said shank of said ring, said ring attachment portion being longitudinally extended, being longer than it is wide, and having an open interior of a length greater than the spacing distance between said two rings, allowing it to be placed over and ride along both rings at the same time, with said clip portion being clipable over and thereby attachable to the bottom-most page of the item, allowing the other pages of the item to be folded open when so clipped and attached, allowing for the viewing of all pages of the item, including the front and back-side of each page, while said ring attachment portion allowing the clipped item to be moved from one side of the binder to the other along the extended length of said shank of said ring, both said ring attachment portion and said clip portion each having separate, longitudinally extended oval shapes, disposed along side of one another in parallel array, and are attached to one another along a common side edge, said ring attachment portion and said clip portion being flat with both lying in the same geometric plane, said clip portion being substantially longer than said ring attachment portion, extending past at least one end of said ring attachment portion; and b. clipping said clip portion to the bottom-most page of the multi-page memento and, after opening said rings, slipping said ring retainer portion over said two rings and then closing said rings, attaching the memento to the rings of the scrapbook binder, while allowing the pages of the bottom-most page to be freely folder open, fully exposing both the front and back page portion of each such page, with the movement of said ring attachment portion over the extended length of the shanks of said rings allowing the clipped memento to be moved from one side of the binder to the other side, exposing the back side of the bottom-most side of the back page of the memento to be viewed, thereby allowing all page of the multi-page item to be viewed without removing the retainer clip from the memento or removing the retainer clip from the rings of the scrapbook binder.

20. The scrapbook method ring binder system of claim 19, wherein the scrapbook ring binder has at least four, spaced rings, the item being retained has a height spanning at least three of said spaced rings, and there are at least two of the retainer clips, the lengths of the ring attachment portion of each of the retainer clips spanning at least two of said four rings, and wherein there is included in step "b" the following further steps:

clipping at least two of the retainer clips onto the item, one located at the top of the item and one located at the bottom of the item, with the ring attachment portion being placed on selected rings with at least one different ring being located in each one of the ring attachment portions of the retainer clips.

* * * * *